US007381296B2

(12) United States Patent
Bakken et al.

(10) Patent No.: US 7,381,296 B2
(45) Date of Patent: Jun. 3, 2008

(54) METHOD OF FORMING DECORATIVE TISSUE SHEETS

(75) Inventors: Andrew Peter Bakken, Appleton, WI (US); Peter John Allen, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 477 days.

(21) Appl. No.: 10/980,729

(22) Filed: Nov. 3, 2004

(65) Prior Publication Data

US 2006/0102302 A1 May 18, 2006

(51) Int. Cl.
*D21F 1/44* (2006.01)
*D21F 11/00* (2006.01)

(52) U.S. Cl. ..... 162/110; 162/116

(58) Field of Classification Search ..... 162/348, 162/900, 902, 903, 358.2, 361, 362, 110, 162/116, 140, 296; 283/113; 139/383 A, 139/425 A; 264/70, 121
See application file for complete search history.

(56) References Cited

U.S. PATENT DOCUMENTS

| | | | | |
|---|---|---|---|---|
| 3,423,266 | A | 1/1969 | Davies et al. | |
| 3,595,731 | A | 7/1971 | Davies et al. | |
| 4,068,036 | A | 1/1978 | Stanistreet | |
| RE30,955 | E | 6/1982 | Stanistreet | |
| 5,429,686 | A | 7/1995 | Chiu et al. | |
| 5,549,790 | A | 8/1996 | Van Phan | |
| 5,609,725 | A | 3/1997 | Van Phan | |
| 5,672,248 | A | 9/1997 | Wendt et al. | |
| D427,472 | S | 7/2000 | Rogers et al. | |
| 6,136,146 | A | 10/2000 | Phan et al. | |
| 6,203,663 | B1 | 3/2001 | Kamps et al. | |
| 6,398,910 | B1 | 6/2002 | Burazin et al. | |
| 6,464,831 | B1 * | 10/2002 | Trokhan et al. | 162/134 |
| D465,094 | S | 11/2002 | Kuehn et al. | |
| 6,554,959 | B2 * | 4/2003 | Von Paleske et al. | 162/109 |
| 6,620,293 | B2 | 9/2003 | Sears et al. | |
| 6,779,683 | B2 | 8/2004 | Taylor et al. | |
| 6,821,385 | B2 | 11/2004 | Burazin et al. | |
| 6,841,037 | B2 * | 1/2005 | Scherb et al. | 162/109 |
| 6,991,846 | B2 * | 1/2006 | Mallol et al. | 428/292.1 |
| 7,141,142 | B2 | 11/2006 | Burazin et al. | |
| 2003/0102098 | A1 | 6/2003 | Allen et al. | |
| 2003/0157300 | A1 | 8/2003 | Burazin et al. | |
| 2004/0118545 | A1 | 6/2004 | Bakken et al. | |
| 2004/0118546 | A1 | 6/2004 | Bakken et al. | |
| 2004/0126601 | A1 | 7/2004 | Kramer et al. | |

FOREIGN PATENT DOCUMENTS

| | | | |
|---|---|---|---|
| EP | 1122360 | * | 8/2001 |
| WO | WO 96/35018 A1 | | 11/1996 |

* cited by examiner

*Primary Examiner*—Eric Hug
(74) *Attorney, Agent, or Firm*—Gregory E. Croft

(57) ABSTRACT

Forming fabrics for making tissue webs are provided with structural icons on the side of the fabric that does not contact the tissue web during formation. The resulting tissue web has good formation without pinholes, yet contains a watermark corresponding to the shape of the structural icon.

12 Claims, 9 Drawing Sheets

METHOD OF FORMING DECORATIVE TISSUE SHEETS

BACKGROUND OF THE INVENTION

In the manufacture of tissue products such as facial tissue, bath tissue, paper towels, table napkins and the like, there is always a need to improve the aesthetic appeal of the products. In some instances, a very subtle decorative marking, such as a watermark, can be very effective. However, known methods of creating such markings can be detrimental to the formation quality of the tissue. Other methods can be expensive due to the need for additional apparatus or processing. Therefore there is a need for a simple, yet effective, method for imparting decorative markings to tissue sheets.

SUMMARY OF THE INVENTION

It has now been discovered that a simple and effective method of forming tissue sheets with watermarks can be carried out by providing a forming fabric with structural icons (hereinafter described) on the side of the forming fabric that does not contact the newly-formed sheet (the machine-contacting side of the forming fabric). By placing the structural icons on the machine-contacting side of the forming fabric, sheet formation is only subtly affected to produce a region of lower basis weight corresponding to the position and shape of the structural icons. At the same time, pinholes are avoided and the overall strength of the tissue sheet is maintained at a sufficient level. As a result, a very attractive tissue sheet having decorative watermarks is produced.

Hence, in one aspect the invention resides in a method of forming a tissue sheet in which papermaking fibers are deposited onto a forming fabric and retained on the surface of the forming fabric to form a sheet, the forming fabric having a sheet-contacting side and an opposite machine-contacting side, wherein the forming fabric comprises one or more structural icons on the machine-contacting side of the forming fabric which create a watermark in the sheet during formation. By providing the machine-contacting side of the forming fabric with structural icons, watermarks are imparted to the sheet without significantly degrading the formation of the sheet with pinholes. The method of this invention is not only applicable to wet-forming methods of making tissue, but is also applicable to air-forming methods since in both cases the fibers are carried by a fluid (water or air) and the flow of the fluid/fiber suspension is altered by the presence of the structural icons as the suspension is deposited onto a forming fabric. Also, the method of this invention is suitable for all kinds of formers, particularly including crescent formers and c-wrap twin-wire formers.

In a more specific aspect, the invention resides in a method of forming a tissue sheet comprising: (a) depositing an aqueous suspension of papermaking fibers onto the sheet-contacting surface of a forming fabric having one or more structural icons on the machine-contacting side of the fabric; and (b) draining water from the aqueous suspension of fibers through the forming fabric to form a web, whereby water drainage through the machine-contacting side of the forming fabric is impeded by the presence of the structural icons, thereby creating a corresponding region of lower basis weight in the resulting web.

In another aspect, the invention resides in a papermaking forming fabric having a sheet-contacting side and a machine-contacting side, wherein one or more structural icons are positioned on the machine-contacting side of the fabric.

In another aspect, the invention resides in a single-ply tissue sheet comprising one or more "shaded" watermarks.

As used herein, a "watermark" is a visually discernable mark in a tissue sheet created by an area or areas of lower basis weight relative to the balance of the sheet. These lower basis weight areas often have a translucent appearance. For purposes herein, "shaded" watermarks are watermarks having distinct regions of two, three, four or more different basis weights relative to the surrounding area of the sheet and which provide the watermark with corresponding areas of differing translucency or shading, thereby resulting in a more distinctive artistic visual effect as compared to watermarks created by simple lines of lower basis weight.

As used herein, a "structural icon" is a structure on or within a fabric which is intended to impart a watermark to the tissue sheet. The presence of the structural icon impedes the flow of fluid through the fabric and alters the fiber formation and basis weight distribution of the tissue sheet within its zone of influence to form a corresponding watermark of similar shape and size in the resulting tissue sheet. The structural icon is preferably not a solid mass of material, but instead comprises a multiplicity of very small spaced-apart elements, such as a plurality of small dots, which, when viewed collectively, create the overall appearance of the structural icon. Applicants refer to this arrangement as "pixelation". It has been found that, because of the relatively low basis weights associated with tissue sheets, structural icons which are formed from a solid mass of material can result in the formation of pinholes in the sheet because of the relatively severe restriction to fluid flow through the sheet, particularly in those cases where a relatively thin single-layer forming fabric is being used. The concern is lessened as the forming fabric becomes thicker, such as for double-layer or triple-layer fabrics. However, by providing pixilated structural icons, in which the structural icons are formed from a multiplicity of very small elements, additional fluid flow through the fabric in the area of the structural icon is enabled. It has been found that this additional fluid flow can be sufficient to avoid pinhole formation.

The overall form of the structural icon can be any form suitable for producing a watermark, such as letters, words, logos, trademarks, objects, animals, abstract forms, shapes, lines and the like. Compared to the structural features inherent in the forming fabric, the structural icons are widely spaced in order to be visible to the naked eye and be distinguished from the overall background of the sheet.

When used, the elements which make up the structural icons can be any shape, such as dots, squares, triangles, hexagons and the like. The aspect ratios of the elements can be 1 or greater. However, the elements must be relatively small in comparison to the overall size of the structural icon. More specifically, the maximum dimension of the individual elements, which for purposes of simplicity is sometimes referred to herein as the "size" of the element, can be about 2 millimeters (mm) or less, more specifically about 1.5 mm or less, more specifically from about 0.2 to about 2 mm, more specifically from about 0.2 to about 0.8 mm, and still more specifically from about 0.4 to about 0.6 mm.

The spacing of the elements within the structural icons can be uniform or variable. In general, the element spacing can be about the same as the size of the elements. Specifically, the element spacing can be from about 0.2 to about 2 mm, more specifically from about 0.2 to about 1 mm, and still more specifically from about 0.4 to about 0.8 mm.

The element density can be from about 25 to about 500 elements per square centimeter, more specifically from about 25 to about 400 elements per square centimeter, still more specifically from about 25 to about 300 elements per square centimeter, still more specifically from about 50 to about 300 elements per square centimeter, and still more specifically from about 50 to about 150 elements per square centimeter.

Selectively variable element spacing, or selectively variable element sizes, provides the unique ability to intentionally produce "shades of gray" in the resulting watermark as previously mentioned. These shaded areas have different light transmission levels due to their resulting different basis weights, which can improve the aesthetic appearance of the watermark and the product containing the tissue sheet. Reducing the spacing between the elements (or increasing the size of the elements at constant element spacing) within a particular area of the structural icon makes the corresponding area of the watermark darker, i.e. more dissimilar to the average basis weight of the tissue sheet, whereas increasing the spacing between the elements (or decreasing the size of the elements at constant element spacing) makes the corresponding area of the watermark lighter, i.e. more similar to the average basis weight of the tissue sheet. This capability can provide very attractive shaded watermarks which cannot be formed by conventional watermarking methods, which are uniform or substantially uniform in appearance.

Suitable means for creating the elements making up the structural icons particularly include, without limitation, silk screening and printing. Suitable materials to be applied to the fabric include any material that will harden and maintain its shape in use, such as silicone polymers, polyurethane, polyethylene, polypropylene and the like. Whichever means is used to form the elements, it is important that the material being applied does not penetrate the forming fabric to the extent that the material clogs all of the internal fluid passageways within the fabric from one side to the other in the area of the structural icon. Total penetration effectively eliminates the advantage of placing the icon on the machine-contacting side of the fabric. It is advantageous to keep the material confined as much as possible to the machine-contacting side of the fabric for optimal effect.

If the structural icons are not formed using elements, but are formed by solid lines and areas and the like or other relatively large structures, the structural icons can be created by the same means described above, as well as by stitching, overlaying a decorative fabric layer to create a composite fabric, or weaving a decorative design pattern into the fabric, such as can be done with a Jacquard loom. Such structural icons can be effective in producing pinhole-free watermarks, especially when used in conjunction with relatively thick forming fabrics, such as those having two or more layers.

Forming fabrics useful for purposes of this invention include single-layer, double-layer, triple-layer, or other multi-layer fabrics. The single-layer fabrics typically have the least thickness in the z-direction and the triple-layer fabrics or fabrics having more than three layers have correspondingly greater thickness. It has been discovered that the size of the watermark on the tissue sheet varies with the thickness of the forming fabric. For a given structural icon size, the size of the watermark will decrease as the thickness of the fabric increases. As the structural icon is placed further from the sheet-contacting surface, its impact on the lateral movement of the fibers will decrease. Therefore a larger structural icon can be used on a triple layer fabric and achieve the same watermark size as a smaller structural icon used on a single-layer fabric. It is typical for a good watermark to be from about 10 to about 25 percent smaller than the size of the structural icon.

The basis weight of the tissue sheets to which the watermarks are applied in accordance with this invention is preferably about 40 grams per square meter (gsm) or less, more specifically from about 10 to about 40 gsm, more specifically from about 10 to about 35 gsm, more specifically from about 10 to about 30 gsm and still more specifically from about 10 to about 20 gsm. Heavier basis weight papers can be made using the methods of this invention, but an advantage of this invention is lost on heavier weight papers because they can be made using conventional watermark technology, albeit without shading. However, for lightweight tissue grades, conventional watermark technology tends to create pinholes in the sheet.

The degree to which pinholes are present in a tissue sheet can be quantified by the Pinhole Coverage Index, the Pinhole Count Index and the Pinhole Size Index, all of which are determined by an optical test method known in the art and described in U.S. patent application Ser. No. US 2003/0157300 A1 to Burazin et al. entitled "Wide Wale Tissue Sheets and Method of Making Same", published Aug. 21, 2003, which is herein incorporated by reference. More particularly, the "Pinhole Coverage Index" is the arithmetic mean percent area of the sample surface area, viewed from above, which is covered or occupied by pinholes. For the tissue sheets of this invention, the Pinhole Coverage Index can be about 0.25 or less, more specifically about 0.20 or less, more specifically about 0.15 or less, and still more specifically from about 0.05 to about 0.15. The "Pinhole Count Index" is the number of pinholes per 100 square centimeters that have an equivalent circular diameter (ECD) greater than 400 microns. For the tissue sheets of this invention, the Pinhole Count Index can be about 65 or less, more specifically about 60 or less, more specifically about 50 or less, more specifically about 40 or less, still more specifically from about 5 to about 50, and still more specifically from about 5 to about 40. The "Pinhole Size Index" is the mean equivalent circular diameter (ECD) for all pinholes having an ECD greater than 400 microns. For the tissue sheets of this invention, the Pinhole Size Index can be about 600 or less, more specifically about 500 or less, more specifically from about 400 to about 600, still more specifically from about 450 to about 550.

In the interests of brevity and conciseness, any ranges of values set forth in this specification are to be construed as written description support for claims reciting any sub-ranges having endpoints which are whole number values within the specified range in question. By way of a hypothetical illustrative example, a disclosure in this specification of a range of 1-5 shall be considered to support claims to any of the following sub-ranges: 1-4; 1-3; 1-2; 2-5; 2-4; 2-3; 3-5; 3-4; and 4-5.

DETAILED DESCRIPTION OF THE DRAWINGS

Figure 1:
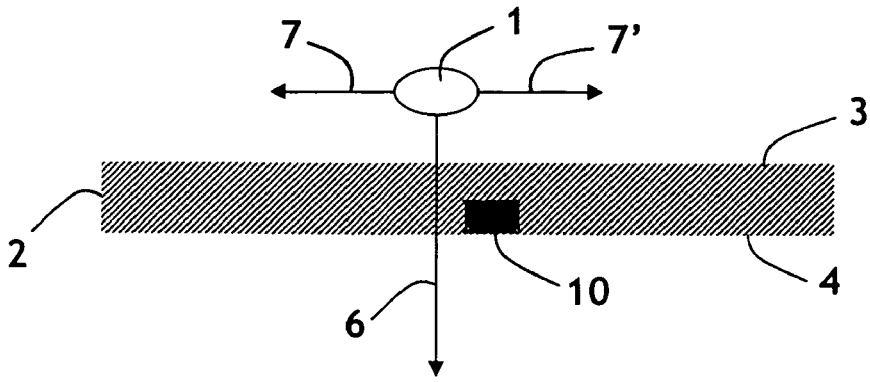
FIG. 1 is a schematic diagram illustrating the directional movement of fibers as they are deposited onto a forming fabric to form the sheet.

Referring to FIG. 1, the invention will be further described. Shown are a fiber 1 and a fabric 2 having a sheet-contacting surface 3 and a machine-contacting surface 4. As shown, the drainage process during formation is a combination of two forces, namely the dewatering force (depicted by arrow 6) which is perpendicular to the surface of the forming fabric and a lateral force (depicted by arrows 7 and 7') imparted by the presence of a fluid flow obstacle 10 (which represents a structural icon) in the path of the dewatering force. Lateral movement is increased by the size of the fluid flow obstacle in the plane of the fabric and the distance from the fiber to the fluid flow obstacle.

Figure 2:
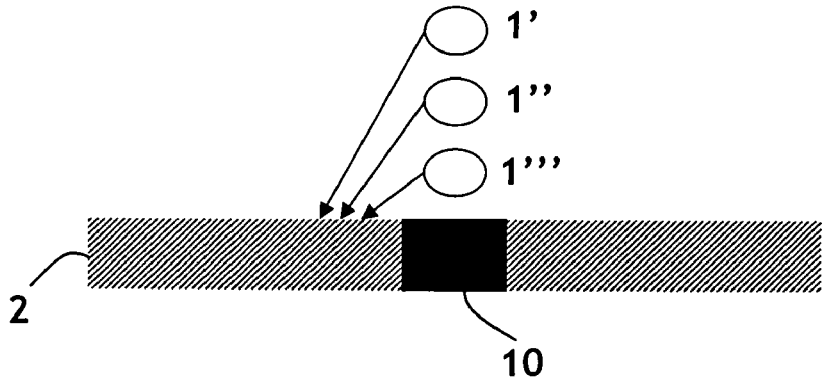
FIG. 2 is a schematic diagram similar to that of FIG. 1, illustrating fiber movement when a fluid flow obstacle is present throughout the entire thickness of the fabric.
Figure 3:
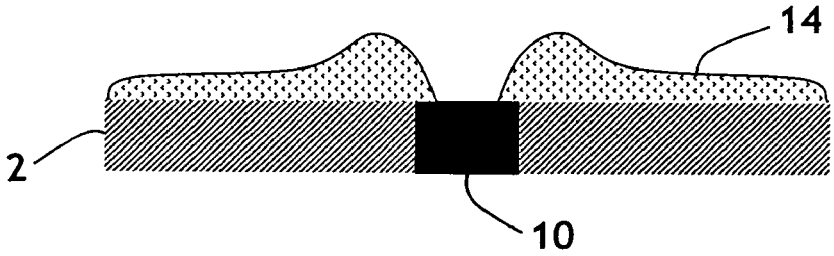
FIG. 3 is a schematic diagram illustrating the fiber distribution on the sheet-contacting side of the fabric of FIG. 2.

Referring to FIG. 2, because fibers 1', 1" and 1'" are at varying heights above the fixed fabric surface during formation, there is a distribution of the magnitude of lateral movement before a fiber can no longer move by being pinned against the fabric surface or a fiber already pinned to the fabric surface. Ideally, for purposes of this invention, the fluid flow obstacle is designed to distribute the basis weight of the fibers non-uniformly, thereby producing a subtle, yet noticeable, pattern in the sheet while not reducing the basis weight of the sheet near the element below that which is required to produce a continuous sheet (the pinhole limit). The formation of a pinhole is depicted in FIG. 3, where the fiber distribution 14 is such that there is an absence of fibers on the surface of the fabric in the area above the fluid flow obstacle.

Figure 4:
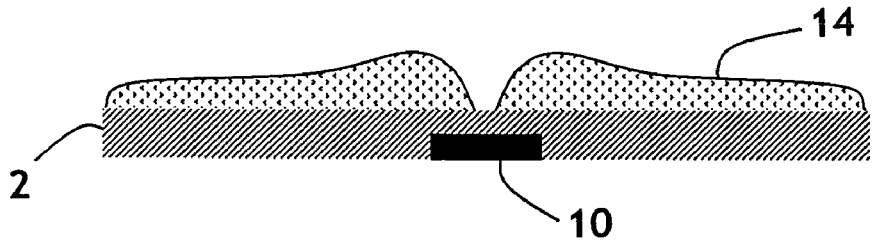
FIG. 4 is a schematic diagram similar to that of FIG. 3 wherein the fluid flow obstacle is present on the machine-contacting side of a single-layer fabric.

FIG. 4 illustrates the effect on fiber distribution when the fluid flow obstacle is placed on the machine-contacting side of the fabric, as opposed to having the fluid flow obstacle present throughout the thickness of the fabric. As compared to FIG. 3, there is an improvement in the formation, although there is still a pinhole present. In practice, avoiding pinhole formation is a function of the thickness and porosity of the fabric and the size and porosity of the fluid flow obstacle.

Figure 5:
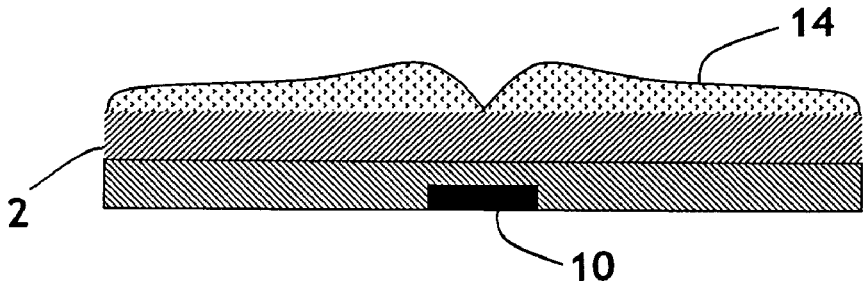
FIG. 5 is a schematic diagram similar to that of FIG. 4, except the fabric is a double-layer fabric.

FIG. 5 is similar to FIG. 4, except the fabric is a double-layer fabric in which the fluid flow obstacle is effectively positioned further away from the sheet-contacting surface. Consequently, the fiber distribution is improved and the pinhole is eliminated.

Figure 6:
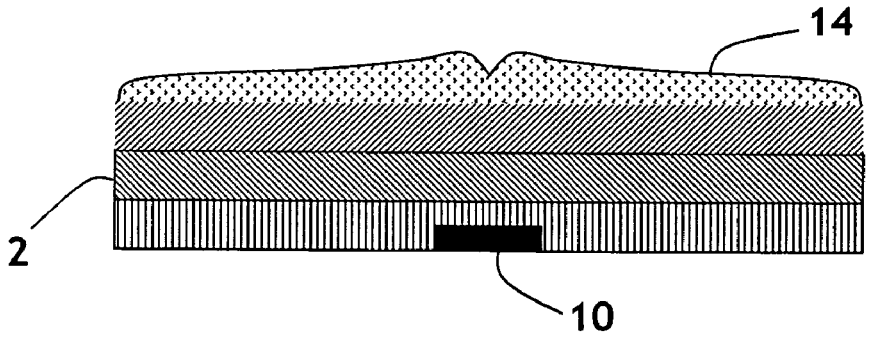
FIG. 6 is a schematic diagram similar to that of FIG. 4, except the fabric is a triple-layer fabric.

FIG. 6 is similar to FIGS. 4 and 5, but carrying the concept a step further with a triple-layer fabric. As a result, the fiber distribution is further improved.

Figure 7B:
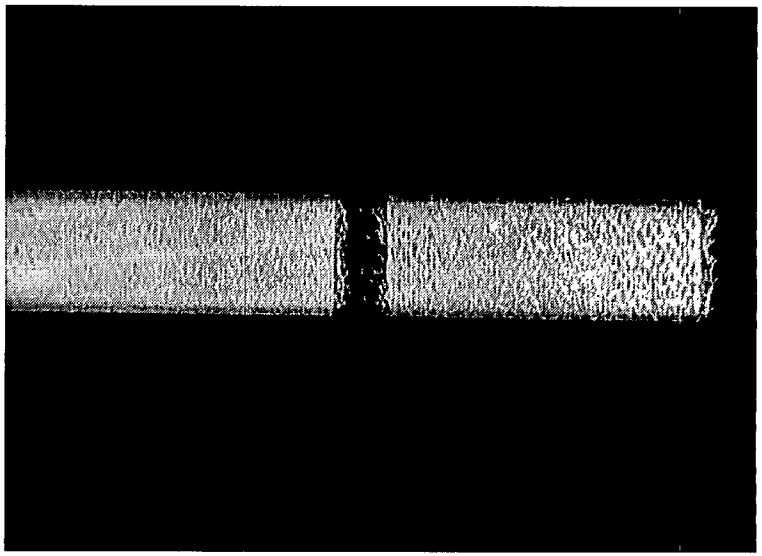
FIGS. 7A and 7B are plan views of a section of two tissue handsheets produced as described in Example 1, illustrating the effect of placing the same fluid flow obstacle on the machine-contacting surface of a single-layer fabric (FIG. 7A) as compared to placing it on the sheet-contacting surface (FIG. 7B).
Figure 7A:
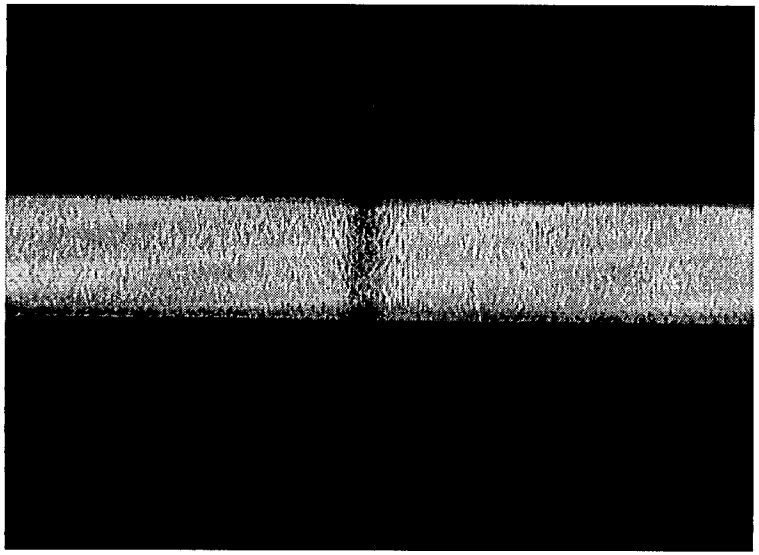

FIGS. 7A and 7B are plan views of tissue sheets made in accordance with Example 1 described below. In both cases, a single-layer forming fabric was used. A fluid flow obstacle consisting of a thin polymer strip having a width of 3.18 mm was placed on machine-contacting surface (FIG. 7A) and the sheet-contacting surface (FIG. 7B). The fluid flow obstacle represents a structural icon for producing a water mark. As shown, for this particular fabric and fluid flow obstacle size, the fiber distribution of the tissue sheet of FIG. 7A barely covered the area corresponding to the position of the fluid flow obstacle in the forming fabric. In the tissue sheet of FIG. 7B, the fiber distribution did not cover the area corresponding to the position of the fluid flow obstacle, resulting in a hole.

Figure 8B:
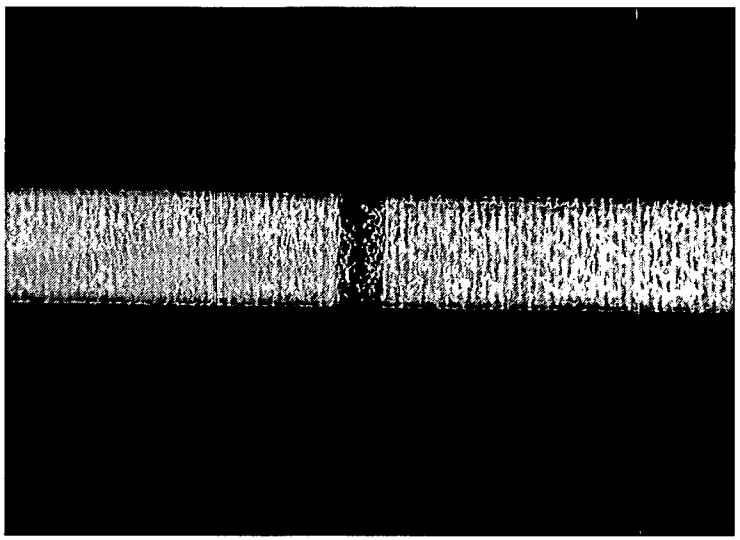
FIGS. 8A and 8B are plan views of a section of two tissue handsheets produced as described in Example 2, illustrating the effect of placing the same fluid flow obstacle used in Example 1 on the machine-contacting surface of a double-layer fabric (FIG. 8A) as compared to placing it on the sheet-contacting surface (FIG. 8B).
Figure 8A:
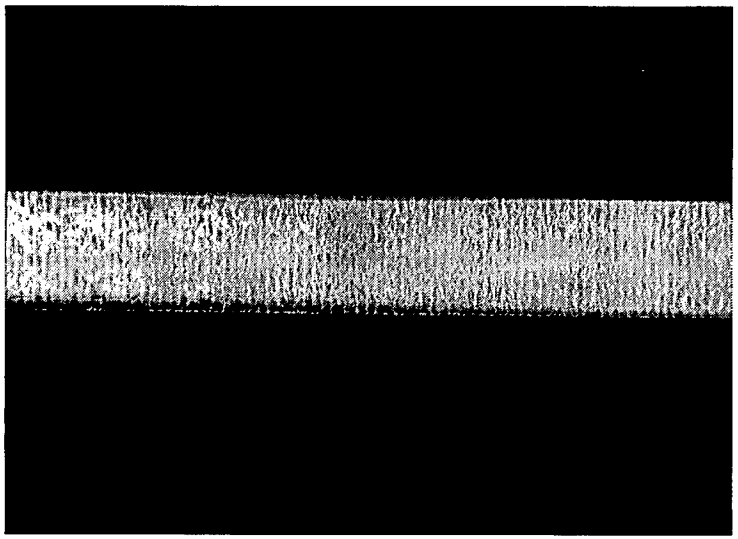

FIGS. 8A and 8B are plan views of tissue sheets made in accordance with Example 2 described below using the same fluid flow obstacle, but with a double-layer fabric. As shown, the fiber distribution covered the area corresponding to the fluid flow obstacle when the fluid flow obstacle was placed on the machine-contacting side of the forming fabric (FIG. 8A), but did not cover the area corresponding to the fluid flow obstacle when the fluid flow obstacle was placed on the sheet-contacting side of the forming fabric (FIG. 8B). FIG. 8A represents a watermark in accordance with this invention.

Figure 9B:
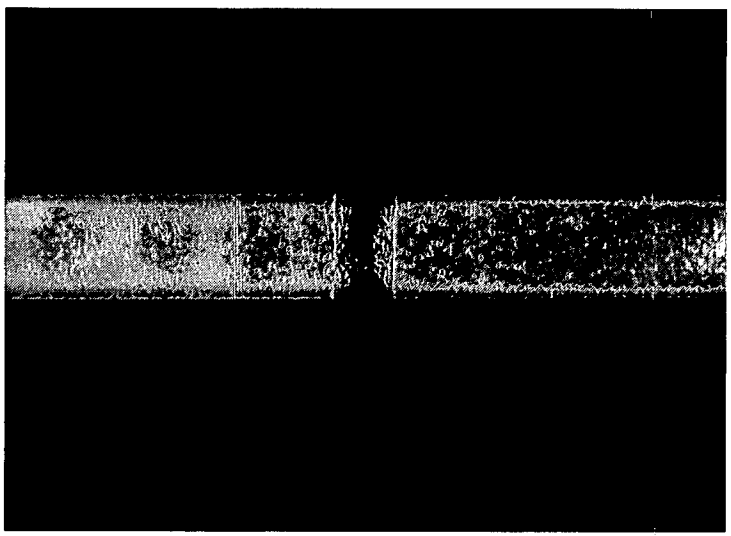
FIGS. 9A and 9B are plan views of a section of two tissue handsheets produced as described in Example 3, illustrating the effect of placing the same fluid flow obstacle used in Example 1 on the machine-contacting surface of a triple-layer fabric (FIG. 9A) as compared to placing it on the sheet-contacting surface (FIG. 9B).
Figure 9A:
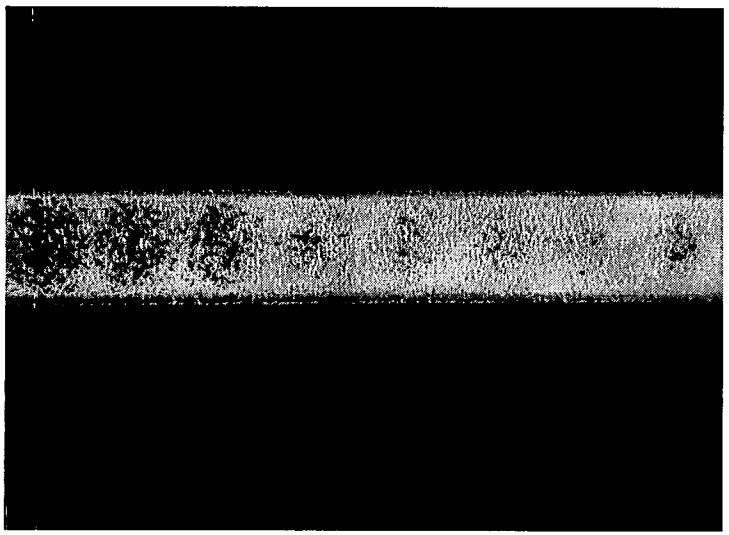

FIGS. 9A and 9B are plan views of tissue sheets made in accordance with Example 3 described below using the same fluid flow obstacles, but with a triple-layer fabric. As shown, the fiber distribution covered the area corresponding to the fluid flow obstacle when the fluid flow obstacle was placed on the machine-contacting side of the forming fabric (FIG. 9A), but did not cover the area corresponding to the fluid flow obstacle when the fluid flow obstacle was placed on the sheet-contacting side of the forming fabric (FIG. 9B). FIG. 9A represents a watermark in accordance with this invention.

Figure 10:
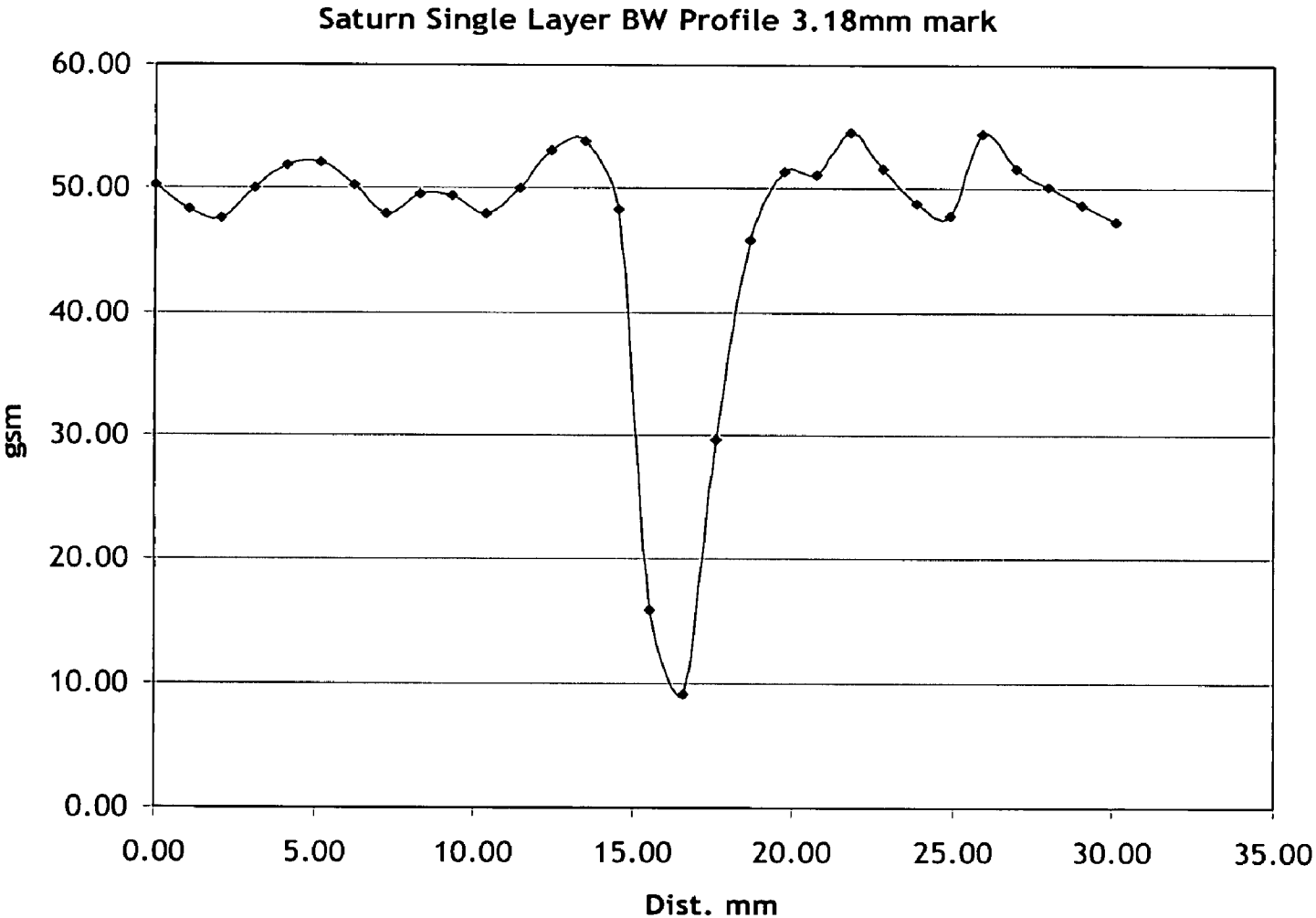
FIG. 10 is a plot of the basis weight profile of the tissue handsheet produced in Example 1.

FIG. 10 is a plot of the fiber distribution for the tissue sheet of Example 1 shown in FIGS. 7A and 7B.

Figure 11:
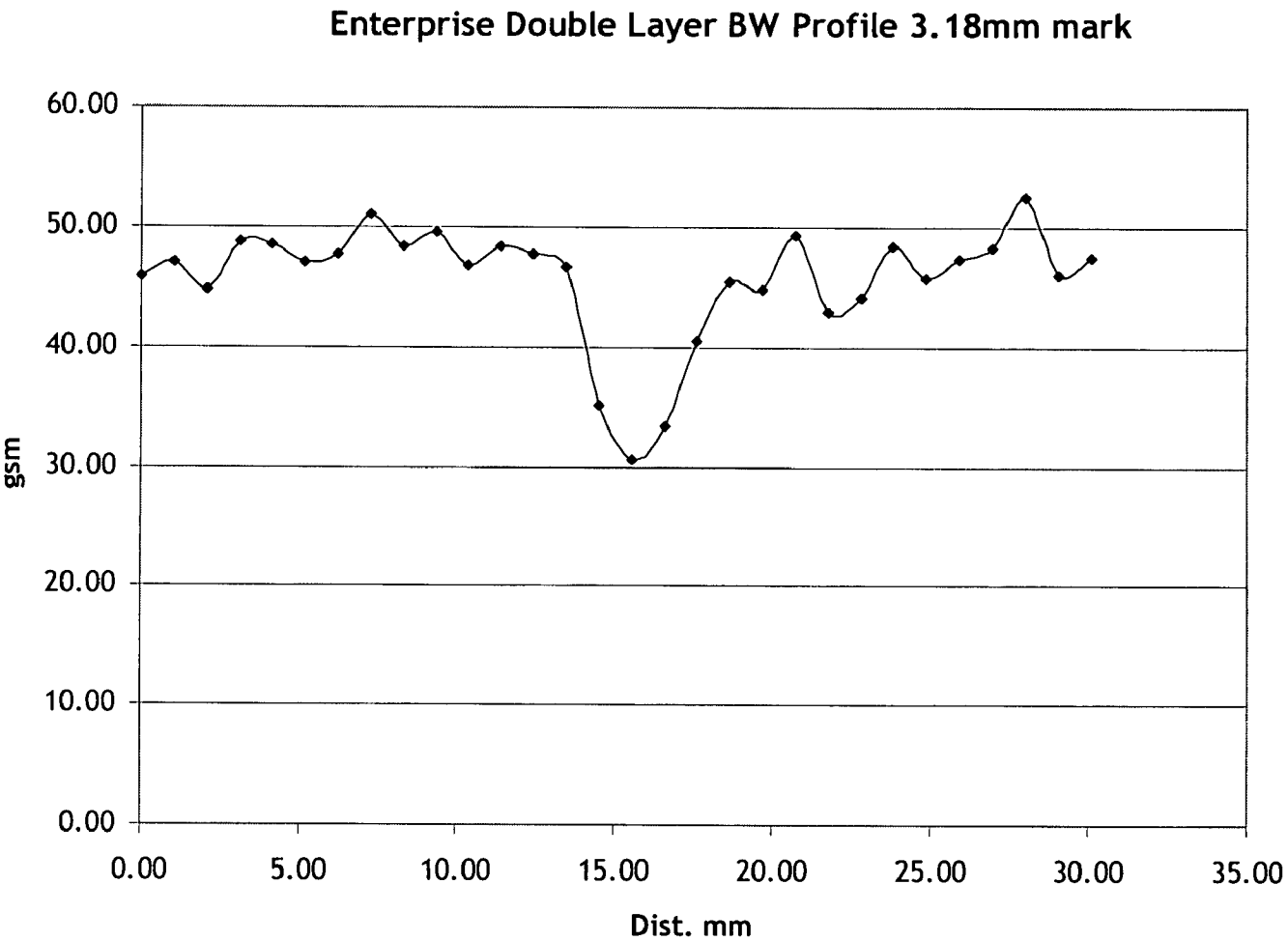
FIG. 11 is a plot of the basis weight profile of the tissue handsheet produced in Example 2.

FIG. 11 is a plot of the fiber distribution for the tissue sheet of Example 2 shown in FIGS. 8A and 8B.

Figure 12:
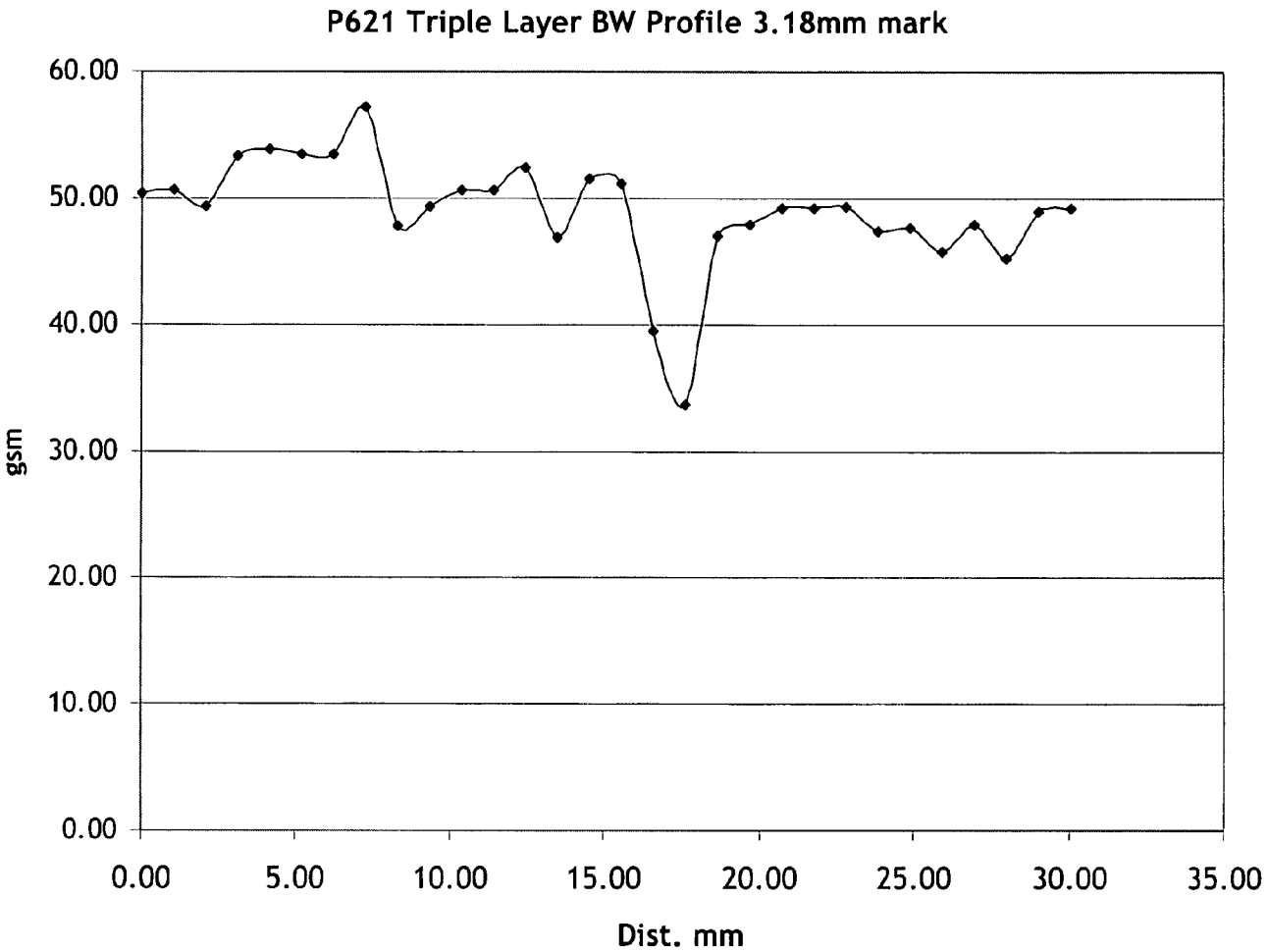
FIG. 12 is a plot of the basis weight profile of the tissue handsheet produced in Example 3.

FIG. 12 is a plot of the fiber distribution for the tissue sheet of Example 3 shown in FIGS. 9A and 9B.

Figure 13:
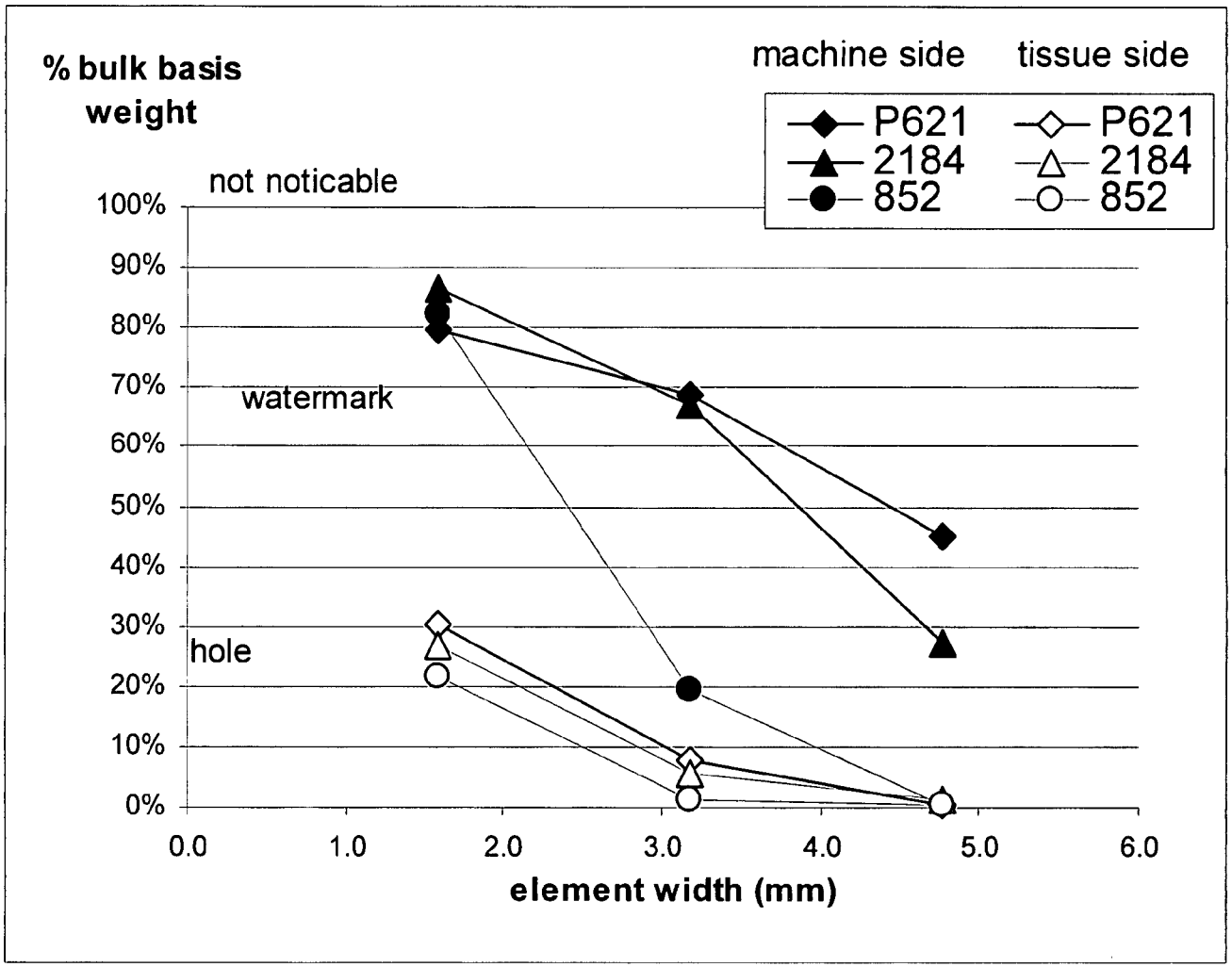
FIG. 13 is a graph summarizing data gathered in Examples 1-3, illustrating the effect on basis weight by the line width of the fluid flow obstacle, the position of the fluid flow obstacle and the type of fabric.

FIG. 13 is a plot of the results of Examples 1-3 and is discussed below in connection with the Examples.

EXAMPLES

Examples 1-3

Thin plastic strips of three different widths were selected to represent structural icons and were adhered to the sheet-contacting surface and the machine-contacting surface of three different forming fabrics. The plastic strips (3M SCOTCH® part 218, 3M, St. Paul, Minn.) had widths of 1/16 inch (1.59 mm), 1/8 inch (3.18 mm) and 3/16 inch (4.76 mm).

The three forming fabrics employed were: a single-layer fabric (Saturn 852 from Voith Fabrics, Heidenheim, Germany); a double-layer fabric (Enterprise 2184-E43S from Voith Fabrics); and a triple-layer fabric (P621 from Albany Fabrics, Albany, N.Y.). Six different handsheets were made on each of the three forming fabrics in a conventional manner. For each of the three different plastic strip widths, one handsheet was made with the plastic strip on the sheet-contacting side of the fabric and one handsheet was made with the plastic strip on the machine-contacting side of the fabric.

To make the handsheets, an aqueous fiber slurry containing about 99 weight percent water and about 1 weight percent fiber was prepared. The fiber portion of the aqueous slurry contained 66 dry weight percent eucalyptus fibers and 33 dry weight percent northern softwood kraft fibers. The aqueous slurry was dispersed in a handsheet mold and drained through the test fabric to form the handsheet in a conventional manner. The resulting sheet was removed from the forming fabric and oven-dried.

Photographs of some of the resulting handsheets are shown in FIGS. 7, 8 and 9. Specifically, FIGS. 7A and 7B are handsheets made on the single-layer forming fabric with the 3.18 mm wide plastic strip. In FIG. 7A, the plastic strip was placed on the machine-contacting surface of the fabric, whereas in FIG. 7B, the plastic strip was placed on the sheet-contacting surface of the fabric. As shown, the formation was completely disrupted in the sheet of FIG. 7B, whereas the formation was substantially disrupted, but not completely, in FIG. 7A.

FIGS. 8A and 8B are the corresponding photographs for the handsheets made using the double-layer forming fabric with the same plastic strip width of 3.18 mm. As shown in the photographs, the handsheet of FIG. 8A, for which the plastic strip was placed on the machine-contacting surface of the forming fabric, has a watermark in the area corresponding to the placement of the plastic strip, whereas the handsheet of FIG. 8B had formation completely disrupted.

FIGS. 9A and 9B are corresponding photographs for handsheets made using the triple-layer fabric with the same plastic strip width of 3.18 mm. The results are similar to those illustrated in FIGS. 8A and 8B.

Although not shown, the results were similar for handsheets made using the smaller (1.59 mm) and larger (4.76 mm) plastic strips.

To further illustrate the results, an image analysis method was developed and used to measure basis weight profiles across watermarks formed in the tissue samples. The basis weight profiles were developed from gray-scale calibration curves and consisted of both "macro" and "micro" resolution measurements. In order to measure basis weight using image analysis, a Quantimet 600 IA System (Leica, Inc., Cambridge, UK) was used along with a Quantimet User Interactive Programming System (QUIPS) routine to acquire calibration data. The optical configuration included a SONY® 3CCD video camera, a 35-mm adjustable Nikon lens (f/2.8), four flood lamps, a black photo drape background and a Polaroid MP4 macroviewer pole position of 69.0 cm. Samples sat atop a 12"×12" DCI auto-stage. A No. 5 cork borer (0.9-cm diameter) was used to cut calibration standards from tissue samples. The basis weights of the standards were determined by weighing them using a microbalance. Gray-level values of the standards were subsequently measured using the image analysis set-up.

After calibration, another QUIPS routine was written to incorporate the calibration curve equation under the same optical conditions listed above. The routine was written to acquire 30 "macro" basis weight measurements along the horizontal axis of the images. The spatial resolution of each macro measurement was 1.0 $mm^2$. A gray-level "micro" profile measurement was also made across the horizontal of the image. The horizontal spatial resolution for this measurement was 0.06 mm.

FIGS. 10-12 illustrate some of the data graphically, showing the basis weight profile of handsheets made with the three different fabrics using the 3.18 mm plastic strip. FIG. 10 is the basis weight profile for the single-layer fabric, FIG. 11 is the basis weight profile for the double-layer fabric and FIG. 12 is the basis weight profile for the triple-layer fabric.

Table 1 below contains the basis weight data for all of the Examples. For each sample, the overall basis weight was measured as well as the minimum basis weight for the areas corresponding to each of the six plastic strips. Table 2 contains the same data, but the minimum basis weights are recorded as a percentage of the total basis weight.

TABLE 1

| | | Basis weight of watermark by fabric and mark width | | | | | |
|---|---|---|---|---|---|---|---|
| | Total | Minimum basis weight (gsm) | | | | | |
| | basis | 1.59 mm strip | | 3.18 mm strip | | 4.76 mm strip | |
| Sample | weight (gsm) | Machine-contacting | Sheet contacting | Machine-contacting | Sheet contacting | Machine-contacting | Sheet contacting |
| Saturn | 45.0 | 40.8 | 10.2 | 9.1 | 0 | 0 | 0 |
| Saturn | 74.8 | 72.7 | 45.5 | 50.0 | 26.0 | 15.1 | 10.1 |
| Enterprise | 46.4 | 44.4 | 12.5 | 30.6 | 2.7 | 12.1 | 0 |
| Enterprise | 69.9 | 62.3 | 56.5 | 60.1 | 23.8 | 39.5 | 0 |
| P621 | 50.0 | 40.7 | 17.2 | 33.8 | 3.7 | 20.2 | 0 |
| P621 | 73.5 | 67.3 | 39.8 | 65.4 | 33.4 | 52.1 | 12.3 |

TABLE 2

| | Percentage of basis weight of watermark by fabric and mark width | | | | | | |
|---|---|---|---|---|---|---|---|
| | Total | Minimum basis weight (% of total) | | | | | |
| | basis | 1.59 mm strip | | 3.18 mm strip | | 4.76 mm strip | |
| Sample | weight (gsm) | Machine-contacting | Sheet contacting | Machine-contacting | Sheet contacting | Machine-contacting | Sheet contacting |
| Saturn | 45 | 82 | 22 | 19 | 0 | 0 | 0 |
| Saturn | 74.8 | 90 | 60 | 62 | 37 | 22 | 14 |
| Enterprise | 46.4 | 86 | 27 | 67 | 6 | 27 | 0 |
| Enterprise | 69.9 | 90 | 68 | 83 | 35 | 59 | 0 |
| P621 | 50 | 80 | 30 | 69 | 8 | 45 | 0 |
| P621 | 73.5 | 87 | 55 | 86 | 45 | 71 | 18 |

The data of Tables 1 and 2 shows that the basis weight in the area of the structural icon is always higher when the icon is placed on the machine-contacting side of the fabric. In addition, it is noted that the basis weight increases as the icon size decreases.

FIG. 13 summarizes the results in graphic form. As shown, all of the samples made with the structural icon on the sheet-contacting side of the fabric produced pinholes in the sheet. It is also noted that the triple layer fabric (P621) produces adequate watermarks over a wider range of icon sizes than the double layer (2184) which in turn is better than the single layer (852) when the icon is on the machine-contacting side of the forming fabric.

It will be appreciated that the foregoing examples, given for purposes of illustration, are not to be construed as limiting the scope of the invention, which is defined by the following claims and all equivalents thereto.

We claim:

1. A method of forming a tissue sheet in which papermaking fibers are deposited onto a forming fabric and retained on the surface of the forming fabric to form a sheet having a basis weight of from about 10 to about 40 grams per square meter, the forming fabric having a sheet-contacting side and an opposite machine-contacting side, wherein the forming fabric comprises one or more pixilated structural icons on the machine-contacting side of the forming fabric which create a watermark in the sheet during formation, said pixilated structural icons being formed from a multiplicity of spaced-apart elements having a size of from about 0.2 to about 2 millimeters, a spacing of from about 0.2 to about 2 millimeters, and a density of from about 25 to about 500 elements per square centimeter.

2. The method of claim 1 wherein the sheet is air-formed by depositing the papermaking fibers onto the forming fabric while the papermaking fibers are suspended in air.

3. The method of claim 1 wherein the sheet is wet-formed by depositing the papermaking fibers onto the forming fabric while the papermaking fibers are suspended in water.

4. The method of claim 1 wherein the elements are dots.

5. The method of claim 1 wherein the elements are squares.

6. The method of claim 1 wherein the elements are triangles.

7. The method of claim wherein the elements are hexagons.

8. The method of claim 1 wherein the element density is from about 50 to about 300 elements per square centimeter.

9. The method of claim 1 wherein the size of the elements is from about 0.2 to about 0.8 millimeter.

10. The method of claim 1 wherein the size of the elements is from about 0.4 to about 0.6 millimeter.

11. The method of claim 1 wherein the basis weight of the tissue sheet is from about 10 to about 30 grams per square meter.

12. The method of claim 1 wherein the basis weight of the tissue sheet is from about 10 to about 20 grams per square meter.

* * * * *